US007458227B2

(12) United States Patent
Lee et al.

(10) Patent No.: US 7,458,227 B2
(45) Date of Patent: Dec. 2, 2008

(54) METHOD OF PREVENTING RAPID ON/OFF OF COMPRESSOR IN UNITARY AIR CONDITIONER

(75) Inventors: Won Hee Lee, Seoul (KR); Seung Youp Hyun, Seoul (KR); Jeong Taek Park, Ansan-si (KR); Yoon Jei Hwang, Seoul (KR)

(73) Assignee: LG Electronics Inc., Seoul (KR)

( * ) Notice: Subject to any disclaimer, the term of this patent is extended or adjusted under 35 U.S.C. 154(b) by 259 days.

(21) Appl. No.: 11/316,985

(22) Filed: Dec. 27, 2005

(65) Prior Publication Data

US 2006/0156748 A1 Jul. 20, 2006

(30) Foreign Application Priority Data

Dec. 28, 2004 (KR) ..... 10-2004-0113680

(51) Int. Cl.
*F25B 49/00* (2006.01)
*F25B 1/00* (2006.01)

(52) U.S. Cl. ..... 62/228.5; 62/228.1; 62/157

(58) Field of Classification Search ..... 62/228.5, 62/228.1, 157, 115, 231
See application file for complete search history.

(56) References Cited

U.S. PATENT DOCUMENTS 4,735,054 A 4/1988 Beckey
4,831,313 A * 5/1989 Beilfuss ..... 388/822
4,939,910 A 7/1990 Umezu
5,303,562 A 4/1994 Bahel et al.
5,502,976 A 4/1996 Otori et al.
5,673,568 A * 10/1997 Isshiki ..... 62/228.4

(Continued)

FOREIGN PATENT DOCUMENTS

EP 0269282 6/1988

(Continued)

OTHER PUBLICATIONS

U.S. Appl. No. 11/317,015, to Lee et al., filed Dec. 27, 2005.

(Continued)

*Primary Examiner*—Chen-Wen Jiang
(74) *Attorney, Agent, or Firm*—Greenblum & Bernstein, P.L.C.

(57) ABSTRACT

A method of preventing rapid on/off of a compressor in a unitary air conditioner comprises the steps of, when a unitary-capacity operation signal is inputted from a thermostat to start an outdoor unit, and a specific operation stage is continued for more than a predetermined period of time after the operation is started, changing the operation stage of the outdoor unit to an operation stage higher than the specific operation stage, and operating the outdoor unit in the changed operation stage, and, when the compressor is stopped according to a signal from the thermostat within a specific period of time after the operation stage is changed to an operation stage higher than the specific operation stage, starting the operation in the specific operation stage at the next operation, and still performing the operation in the specific operation stage although the operation state is continued for more than a predetermined period of time. Consequently, the compressor is prevented from being rapidly turned on/off, and therefore, operational reliability of the compressor is improved, and the service life of the compressor is increased.

7 Claims, 3 Drawing Sheets

U.S. PATENT DOCUMENTS

| | | | | |
|---|---|---|---|---|
| 5,934,084 | A | 8/1999 | Lee et al. | |
| 6,134,901 | A | 10/2000 | Harvest et al. | |
| 2004/0016254 | A1* | 1/2004 | Park | 62/229 |
| 2004/0093881 | A1* | 5/2004 | Kim | 62/228.5 |
| 2004/0244389 | A1* | 12/2004 | Denvir | 62/156 |
| 2005/0016192 | A1* | 1/2005 | Park | 62/209 |

FOREIGN PATENT DOCUMENTS

| | | |
|---|---|---|
| EP | 0303245 | 2/1989 |

OTHER PUBLICATIONS

U.S. Appl. No. 11/319,472, to Lee et al., filed on Dec. 29, 2005.

* cited by examiner

METHOD OF PREVENTING RAPID ON/OFF OF COMPRESSOR IN UNITARY AIR CONDITIONER

BACKGROUND OF THE INVENTION

1. Field of the Invention

The present invention relates to a method of controlling a unitary air conditioner widely used in North America, and, more particularly, to a method of preventing rapid on/off of a compressor in a unitary air conditioner having a 1-stage thermostat, which is operably connected to a plural-stage outdoor unit.

2. Description of the Related Art

FIG. 1 is a control circuit block diagram of a conventional 1-stage unitary air conditioner showing connection of principal circuit terminals.

As shown in FIG. 1, the 1-stage unitary air conditioner is constructed such that the 1-stage unitary air conditioner receives an operation signal or a stop signal from a 1-stage thermostat 11, which is mounted in a room, for operating a 1-stage indoor unit 13 and a 1-stage outdoor unit 15.

The 1-stage unitary air conditioner with the above-stated construction is an air-conditioning system widely used as one of household appliances in North America, such as the United States of America. According to an ON/OFF operation signal from the 1-stage thermostat 11, the 1-stage indoor unit 13 and the 1-stage outdoor unit 15 are turned ON/OFF while the capacities of the 1-stage indoor unit 13 and the 1-stage outdoor unit 15 are not changed. In the 1-stage indoor unit 23 is mounted an indoor fan 17, which is rotated such that flow rate of air can be adjusted to high, middle, and low flow rates.

Recently, energy saving and more convenient heating and cooling operation have been increasingly required. To this end, a 2-stage thermostat, by which the operation of the air conditioner is controlled in a high or low operation stage, has been proposed.

FIG. 2 is a control circuit block diagram of a conventional 2-stage unitary air conditioner showing connection of principal circuit terminals.

As shown in FIG. 2, the 2-stage unitary air conditioner comprises a 2-stage thermostat 21. The 2-stage unitary air conditioner is constructed such that a 1-stage indoor unit 23 and a 1-stage outdoor unit 25 are operated in a high or low operation stage, while the capacities of the 2-stage indoor unit 23 and the 2-stage outdoor unit 25 are changed, according to a high operation signal Y2 or a low operation signal Y1 from the 2-stage thermostat 21. In the 2-stage indoor unit 23 is mounted an indoor fan 27, which is rotated such that flow rate of air can be adjusted to high, middle, and low flow rates.

However, the above-described conventional 1-stage unitary air conditioner is constructed such that the 1-stage indoor unit 13 and the 1-stage outdoor unit 15 are connected to the 1-stage thermostat 11. Consequently, it is difficult to connect the 2-stage indoor unit 13 or the 2-stage outdoor unit 15 shown in FIG. 2 to the 1-stage thermostat 11. In other words, it is difficult to connect a multiple-stage indoor unit or a multiple-stage outdoor unit to the 1-stage thermostat 11.

SUMMARY OF THE INVENTION

Therefore, the present invention has been made in view of the above problems, and it is an object of the present invention to provide a method of preventing rapid on/off of a compressor in a unitary air conditioner comprising a 1-stage thermostat connected to a variable-capacity outdoor unit to accomplish various applications, the method being capable of preventing the compressor from being rapidly turned on/off, thereby improving operational reliability of the compressor and increasing the service life of the compressor.

In accordance with the present invention, the above and other objects can be accomplished by the provision of a method of preventing rapid on/off of a compressor in a unitary air conditioner, comprising the steps of: when a unitary-capacity operation signal is inputted from a thermostat to start an outdoor unit, and a specific operation stage is continued for more than a predetermined period of time after the operation is started, changing the operation stage of the outdoor unit to an operation stage higher than the specific operation stage, and operating the outdoor unit in the changed operation stage; and, when the compressor is stopped according to a signal from the thermostat within a specific period of time after the operation stage is changed to an operation stage higher than the specific operation stage, starting the operation in the specific operation stage at the next operation, and still performing the operation in the specific operation stage although the operation state is continued for more than a predetermined period of time.

Preferably, the rapid on/off preventing method further comprises the steps of: when the operation stage is divided into high, middle, and low operation stages, changing the operation stage to the high operation stage if the middle operation stage is continued for more than a first predetermined period of time, and, if the operation time in the high operation stage is within a first specific period of time, starting the operation in the middle operation stage at the next operation, and still performing the operation in the middle operation stage although the operation state is continued for more than the first predetermined period of time; and changing the operation stage to the high operation stage if the low operation stage is continued for more than a second predetermined period of time, and, if the operation time in the high operation stage is within a second specific period of time, starting the operation in the low operation stage at the next operation, and still performing the operation in the low operation stage although the operation state is continued for more than the second predetermined period of time.

Preferably, the first predetermined period of time is set to be greater than the second predetermined period of time, and the first specific period of time, for which the operation is performed in the high operation stage after the operation stage is changed from the middle operation stage to the high operation stage, is set to be greater than the second specific period of time, for which the operation is performed in the high operation stage after the operation stage is changed from the low operation stage to the high operation stage.

According to the present invention, the capacity of the compressor is controlled at the next operation based on the capacity change state of the compressor at the previous operation. Consequently, the compressor is prevented from being rapidly turned on/off, and therefore, operational reliability of the compressor is improved, and the service life of the compressor is increased.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, a preferred embodiment of the present invention will be described in detail with reference to the accompanying drawings.

It should be understood that methods of preventing rapid on/off of a compressor in a unitary air conditioner according to numerous preferred embodiments of the present invention may be proposed, although only the most preferred embodiment of the present invention will be described hereinafter.

Figure 1:
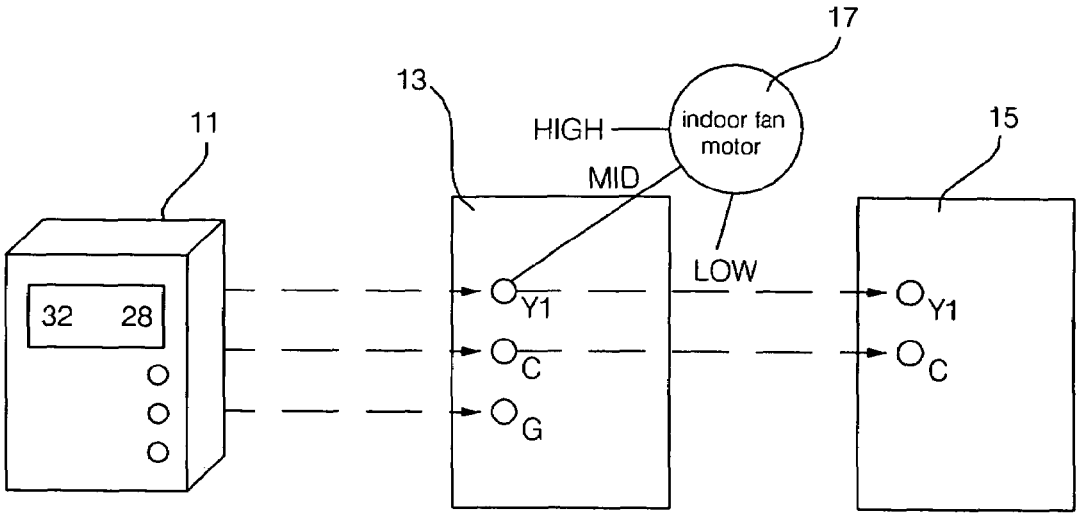
FIG. 1 (Prior Art)
FIG. 1 is a control circuit block diagram showing a conventional 1-stage unitary air conditioner.
Figure 2:
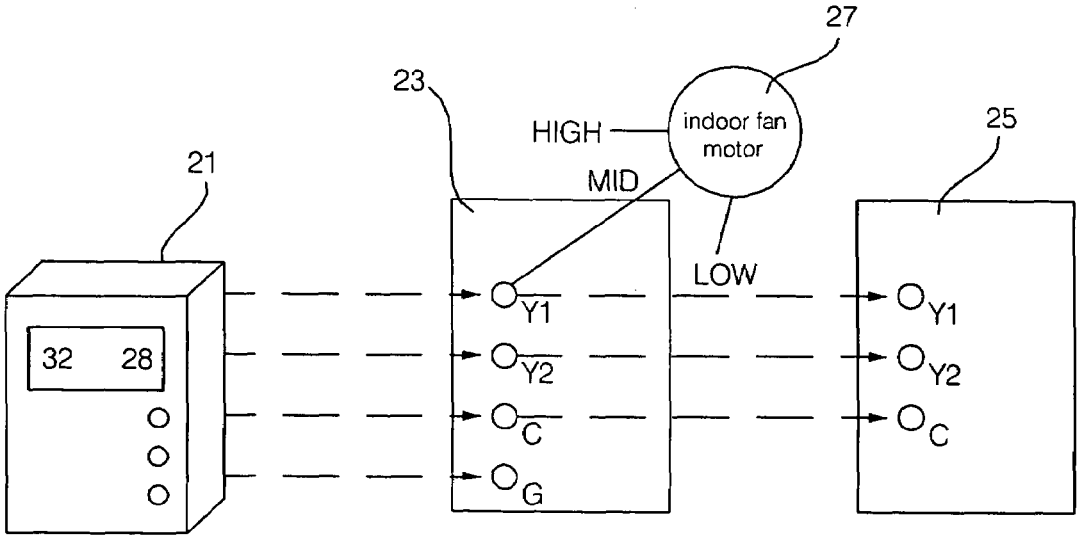
FIG. 2 (Prior Art)
FIG. 2 is a control circuit block diagram showing a conventional 2-stage unitary air conditioner.
Figure 3:
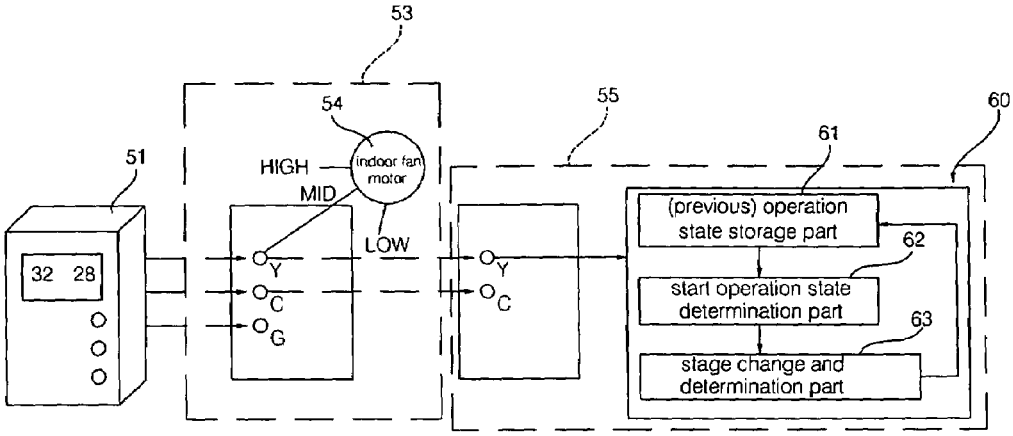
FIG. 3 is a control block diagram showing the construction of a unitary air conditioner according to the present invention.

FIG. 3 is a control block diagram showing the construction of a variable-stage unitary air conditioner according to the present invention.

As shown in FIG. 3, the variable-stage unitary air conditioner according to the first preferred embodiment of the present invention comprises: a 1-stage thermostat 51 mounted in a room; an indoor unit 53 configured to operate based on a signal from the 1-stage thermostat 51; and a variable-capacity outdoor unit 55 connected to the 1-stage thermostat 51 and the indoor unit 53.

The 1-stage thermostat 51 is configured to generate only an ON/OFF signal, by which the air conditioned is turned on/off.

The indoor unit 53 may be configured in 1-stage fashion in which the indoor unit 53 is operated based on only a signal from the 1-stage thermostat 51. Alternatively, the indoor unit 53 may be configured in 2-stage fashion in which the indoor unit 53 is operated based on signals from the 1-stage thermostat 51 and the variable-capacity outdoor unit 55. In the indoor unit 53 is mounted an indoor fan 54, which is preferably rotated in a high, middle, or low operation stage.

The variable-capacity outdoor unit 55 is turned ON/OFF according to a signal from the 1-stage thermostat 51. The variable-capacity outdoor unit 55 is configured such that, during operation of the air conditioner, the capacity of a compressor (not shown) or an outdoor heat exchanger is automatically variable by an outdoor unit control device 60 mounted in the variable-capacity outdoor unit 55.

Specifically, the outdoor unit control device 60 comprises: an operation state storage part 61 for storing the previous or current operation state; a start operation state determination part 62 for determining a start operation stage, based on the previous operation stage stored in the operation state storage part 61, to operate the variable-capacity outdoor unit 55; and a stage change and determination part 63 for determining the operation state of the variable-capacity outdoor unit 55 according to the determination of the start operation state determination part 62 and changing the operation stage.

The compressor may be an inverter type compressor, the capacity of which is variable, or may comprise a plurality of constant-speed compressors. When the compressor comprises the plurality of constant-speed compressors, it is preferable that the capacities of the constant-speed compressors be different from one another, and therefore, the compressor is operated in three stages, for example, high, middle, and low stages.

Now, a method of controlling variable operation of the unitary air conditioner with the above-stated construction according to the present invention will be described.

When a unitary-capacity operation signal Y is inputted to the indoor unit 53 and the variable-capacity outdoor unit 55 from the 1-stage thermostat 51, the start operation state determination part 62 of the variable-capacity outdoor unit 55 determines a start operation stage based on the combination of the operation stage of the variable-capacity outdoor unit 55 operated before the operation signal Y is inputted (hereinafter, referred to as "previous operation") and stored in the previous operation state storage part 61 and the operation time in the stage such that the variable-capacity outdoor unit 55 is operated (hereinafter, referred to as "next operation").

In the following description, the variable-capacity outdoor unit 55 is operated in three operation stages, for example, high, middle, and low operation stages, which are generally used, although the variable-capacity outdoor unit 55 may be operated in various stages.

According to an operation capacity weighted value of each operation stage of the variable-capacity outdoor unit 55, the high operation stage is set to A value, the middle operation stage is set to B value, which is lower than the A value, and the low operation stage is set to C value, which is lower than the B value. The next operation is determined according to an integrated value X, which is converted from the product of the weighted value of each of the successive operation stages in the previous operation and the operation time in each of the operation stages.

According to the operation capacity weighted value, the high operation stage is set to 100, the middle operation stage is set to 55, and the low operation stage is set to 35. When the previous operation was successively carried out for a seconds in the low operation stage, b seconds in the middle operation stage, and c seconds in the high operation stage, the integrated value X is calculated as follows:

$$X=35\times a+55\times b+100\times c$$

The next operation stage is set according to the integrated value X of the previous successive operation as calculated by the above expression. As indicated in Table 1, the next operation stage is set to the low operation stage if the integrated value X is less than α, the next operation stage is set to the middle operation stage if the integrated value X is between α and β, and the next operation stage is set to the high operation stage if the integrated value X is greater than β.

TABLE 1

| Previous operation state | | Next operation stage |
|---|---|---|
| OFF for 1 hour or more | | High |
| Less than 1 hour | $X < \alpha$ | Low |
| | $\alpha < X < \beta$ | Middle |
| | $X > \beta$ | High |

In Table 1, it is possible that α is set to 60000 and β is set to 120000.

Consequently, when the next operation is started 1 hour or more after the previous operation is completed as indicated in Table 1, the next operation is started in the high operation stage irrespective of the integrated value X of the previous operation. When the next operation is started within 1 hour after the previous operation is completed, on the other hand, the next operation is decided based on the integrated value X of each of the successive operation stages.

When the integrated value, at which the specific operation stage is continued for more than a predetermined period of time, is calculated as indicated in Table 2 after the next operation is started as described above, the current operation stage is changed to the operation stage higher than the specific operation stage.

TABLE 2

| Current operation stage | Integrated value | Changed operation stage |
|---|---|---|
| Low | $X > \alpha'$ | High |
| Middle | $X > \beta'$ | High |

In Table 2, it is possible that $\alpha'$ is set to 42860 and $\beta'$ is set to 90000.

Figure 4:
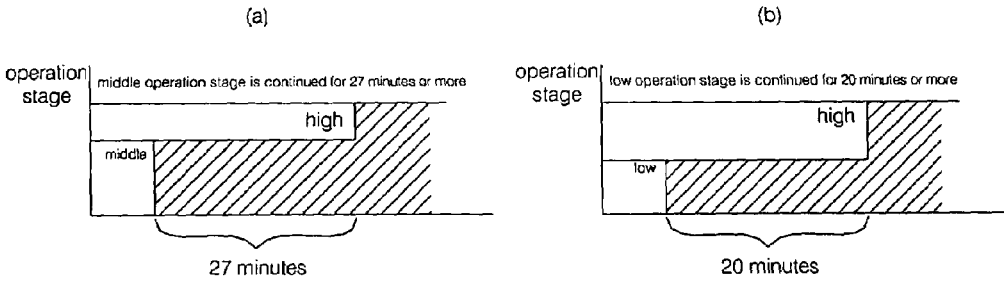
FIG. 4 is a graph illustrating change of the stage based on the operation continuance time in a method of controlling variable operation of a unitary air conditioner according to the present invention.

When the middle operation stage is continued for more than a first predetermined period of time A (for example, 27 minutes or more), as shown in FIG. 4(*a*), it is determined that increase of the indoor cooling capacity is required, and therefore, the operation stage is changed to the high operation stage and then the operation is carried out. When the low operation stage is continued for more than a second predetermined period of time B (for example, 20 minutes or more), as shown in FIG. 4(*b*), it is determined that increase of the indoor cooling capacity is required, and therefore, the operation stage is changed to the high operation stage and then the operation is carried out.

The reason why the first predetermined period of time, for the middle operation stage is continued, is set to be greater than the second predetermined period of time, for which the low operation stage is continued, is that the outdoor unit is determined to be operated corresponding to a load around the cooling space in the middle operation stage rather than in the low operation stage. When the middle operation stage is continued, however, the operation stage is changed from the middle operation stage to the high operation stage.

When the compressor is stopped according to a signal from the thermostat within a specific period of time after the operation stage is changed to an operation stage higher than the specific operation stage as described above, the operation is performed in the specific operation stage at the next operation, as indicated in Table 3. Although the operation state is continued for more than a predetermined period of time, the operation is performed in the specific operation stage.

TABLE 3

| Previously changed operation state | Next operation stage |
|---|---|
| High operation is performed for less than 5 minutes according to stage increase in low operation | Low |
| High operation is performed for less than 10 minutes according to stage increase in middle operation | Middle |

Figure 5:
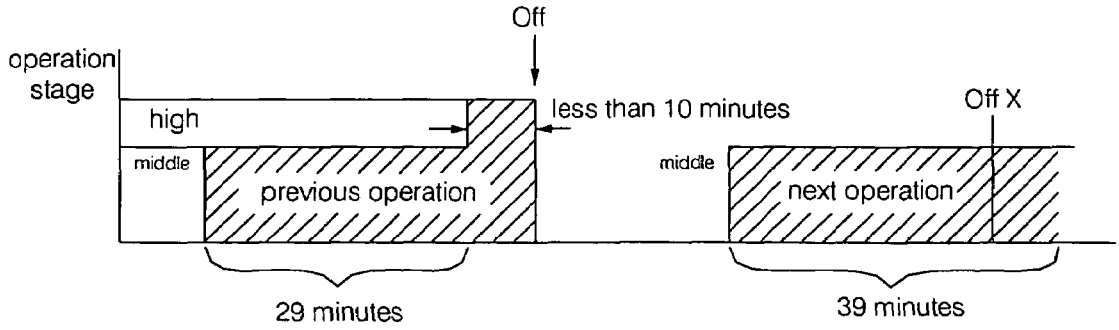
FIG. 5 is a graph illustrating a method of preventing rapid on/off of a compressor in the unitary air conditioner while the unitary air conditioner according to the present invention is operated in a middle operation stage.

When the compressor is stopped according to a signal from the 1-stage thermostat 51 within a first specific period of time Ta (for example, 10 minutes) after the middle operation stage is continued for more than the first predetermined period of time A (for example, 27 minutes or more) and the operation stage is changed from the middle operation stage to the high operation stage, as illustrated in FIG. 5, this operation state is stored in the operation state storage part 61, the next operation is started in the middle operation stage by the start operation state determination part 62, and the operation is still performed by the stage change and determination part 63 although the operation state is continued for more than the first predetermined period of time A (27 minutes or more).

Figure 6:
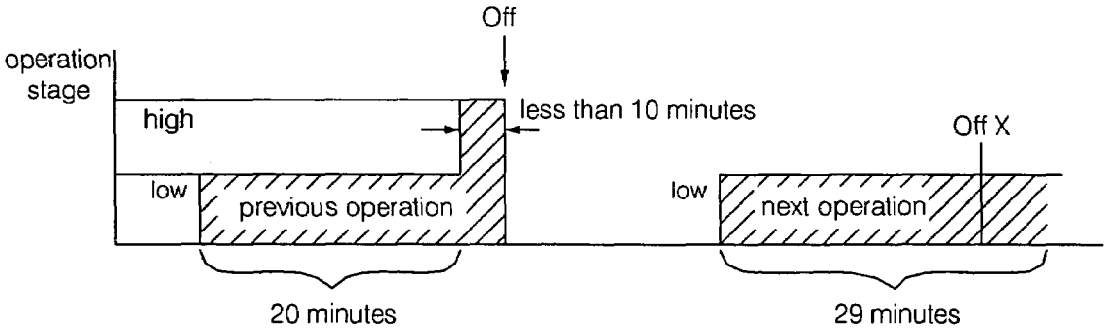
FIG. 6 is a graph illustrating the method of preventing rapid on/off of the compressor in the unitary air conditioner while the unitary air conditioner according to the present invention is operated in a low operation stage.

When the compressor is stopped according to a signal from the 1-stage thermostat 51 within a second specific period of time Tb (for example, 5 minutes) after the low operation stage is continued for more than the second predetermined period of time B (for example, 20 minutes or more) and the operation stage is changed from the low operation stage to the high operation stage, as illustrated in FIG. 6, this operation state is stored in the operation state storage part 61 in the same manner as the above case, the next operation is started in the low operation stage by the start operation state determination part 62, and the operation is still performed by the stage change and determination part 63 although the operation state is continued for more than the second predetermined period of time B (20 minutes or more).

As described above, the operation stage is changed from the middle or low operation stage to the high operation stage, and therefore, the operation capacity of the compressor is increased. When the compressor is stopped within the specific period of time according to the command from the 1-stage thermostat in the above-mentioned state, it is determined that the operation stage properly corresponds to the indoor cooling load although the operation stage is not changed to the high operation stage, and therefore, the operation capacity of the compressor is not increased at the next operation.

As the operation capacity of the compressor is not increased as described above, damage to the compressor, which may occur when the compressor is stopped immediately after the capacity of the compressor is increased, is effectively prevented.

As apparent from the above description, the 1-stage thermostat can be connected to the variable-capacity outdoor unit in various operation stages according to circumstances. Consequently, the present invention has the effect of accomplishing various applications and providing more pleasant air conditioned circumstances.

Furthermore, the capacity of the compressor is controlled at the next operation based on the capacity change state of the compressor at the previous operation. Consequently, the compressor is prevented from being rapidly turned on/off, and therefore, operational reliability of the compressor is improved, and the service life of the compressor is increased.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A method for preventing rapid on/off of a compressor of a unitary air conditioner, comprising:

operating an outdoor unit according to one of a first operation stage, a second operation stage and a third operation stage in response to a unitary-capacity operation signal input from a thermostat;

changing an operation stage of the outdoor unit based on a weighted value and an operation time assigned to the operation stage; and continuing to operate the outdoor unit according to a specific operation stage before changing at the time of a next operation, when the compressor is stopped within a specific time according to a signal from the thermostat.

2. The method according to claim 1, wherein when an integration value of the weighted value and the operation time is less than a first predetermined value, the operation stage of the outdoor unit is changed to the first operation stage, and wherein when the integration value of the weighted value and the operation time is between the first predetermined value and a second predetermined value, the operation stage of the outdoor unit is changed to the second operation stage, and wherein when the integration value of the weighted value and the operation time is greater than the second predetermined value, the operation stage of the outdoor unit is changed to the third operation stage.

3. The method of claim 1, wherein the weighted value assigned to the third operation stage is greater than a weighted value assigned to the second operation stage and greater than a weighted value assigned to the first operation stage, and wherein the weighted value assigned to the second operation stage is greater than the weighted value assigned to the first operation stage.

4. The method of claim 1, wherein after the first operation stage is changed to the third operation stage, if the compressor is stopped within the specific time according to the signal of the thermostat, the outdoor unit continues operation according to the first operation stage at the time of the next operation.

5. The method of claim 1, wherein after the second operation stage is changed to the third operation stage, if the compressor is stopped within the specific time according to the signal of the thermostat, the outdoor unit continues operation according to the second stage at the time of the next operation.

6. The method of claim 1, wherein the specific time differs in a first case in which the operation stage of the outdoor unit is changed from the first operation stage to the third operation stage and a second case in which the operation stage of the outdoor unit is changed from the second operation stage to the third operation stage.

7. The method of claim 1, wherein the specific time in a first case in which the operation stage of the outdoor unit is changed from the second operation stage to the third operation stage is set to be longer than the specific time in a second case in which the operation stage of the outdoor unit is changed from the first operation stage to the third operation stage.

* * * * *